United States Patent [19]

Uchida

[11] Patent Number: 4,736,581

[45] Date of Patent: Apr. 12, 1988

[54] SPINNING WINDER

[75] Inventor: Hiroshi Uchida, Oumihachiman, Japan

[73] Assignee: Murata Kikai Kabushiki Kaisha, Osaka, Japan

[21] Appl. No.: 643,073

[22] Filed: Aug. 22, 1984

[30] Foreign Application Priority Data

Aug. 25, 1983 [JP] Japan ..... 58-155967

[51] Int. Cl.[4] ..... D01H 9/18; D01H 9/00; B65H 67/06

[52] U.S. Cl. ..... 57/281; 57/1 R; 57/90; 57/276; 242/35.5 R; 242/35.5 A

[58] Field of Search ..... 57/1 R, 266, 268, 276, 57/281, 90; 242/35.5 R, 35.5 A; 209/927

[56] References Cited

U.S. PATENT DOCUMENTS 3,154,904 11/1964 Furst ..... 57/281 X
3,195,298 7/1965 Furst ..... 57/1 R
3,768,241 10/1973 Nelson et al. ..... 57/281
4,181,228 1/1980 Hashimoto et al. ..... 242/35.5 A X

FOREIGN PATENT DOCUMENTS 52-557535 5/1977 Japan .
54-106630 8/1979 Japan ..... 57/281
55-119668 9/1980 Japan .
2061333 5/1981 United Kingdom ..... 57/266

*Primary Examiner*—John Petrakes
*Attorney, Agent, or Firm*—Spensley Horn Jubas & Lubitz

[57] ABSTRACT

A spinning winder in which a spinning frame and an automatic winder are integrally associated. The spinning winder provides carrier routes comprising routes for transporting a spinning bobbin from the spinning frame to the automatic winder and routes for returning an empty bobbin discharged from the automatic winder to the spinning frame and also provides a passage for an operator between the spinning frame and the automatic winder.

10 Claims, 5 Drawing Sheets

SPINNING WINDER

BACKGROUND OF THE INVENTION

1. Field of the Invention

The present invention relates to a spinning winder in which a spinning frame and an automatic winder are integrally associated, and a spinning bobbin doffed by the spinning frame is transported to the automatic winder to wind up yarns.

2. Prior Art

To realize the aforementioned spinning winder, at least two carrier routes are necessary, one of which is a route for transporting a spinning bobbin from the spinning frame to the automatic winder, and the other is a route for returning an empty bobbin discharged from the automatic winder to the spinning frame. The presence of the aforesaid carrier routes makes it difficult to provide a passage for an operator between the spinning frame and the automatic winder, and therefore, it is often that the aforesaid carrier routes are provided above the work passage.

However, normally, the operating speed of one automatic winder is several times the spinning speed of one spinning frame. Therefore, in a method for providing a plurality of spinning frames for one automatic winder, it is extremely difficult to provide the aforesaid work passage.

SUMMARY OF THE INVENTION

It is an object of the present invention to propose a spinning winder which provides carrier routes comprising routes for transporting a spinning bobbin from a spinning frame to an automatic winder and routes for returning an empty bobbin discharged from the automatic winder to a spinning frame and also provide a passage for an operator between the spinning frame and the automatic winder.

In accordance with the present invention, there are advantages that a number of spinning frames may be added freely and operatively arranged with respect to one automatic winder, and a work passage of sufficient width may be obtained between the aforesaid winder and the spinning frame.

DETAILED DESCRIPTION OF THE INVENTION

Figure 1:
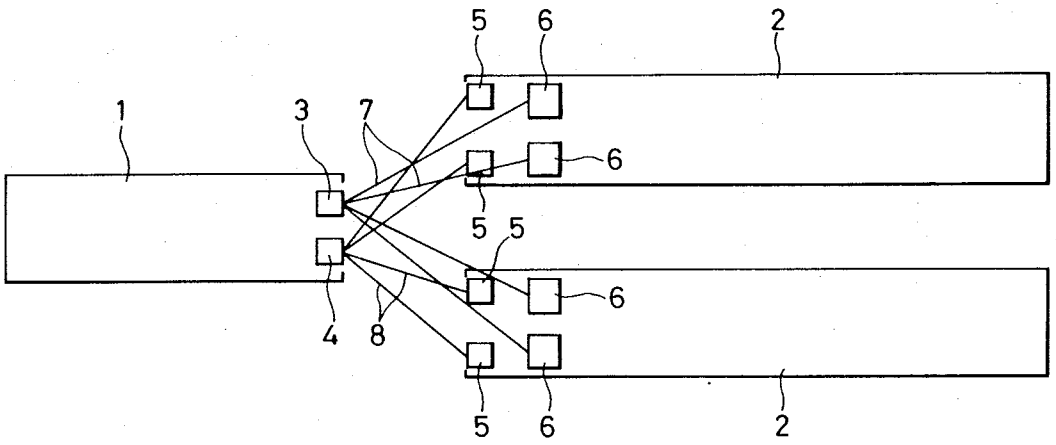
FIG. 1 is a view for explaining the object of the present invention.

An object of the present invention will be explained referring to FIG. 1. FIG. 1 shows the case in which two spinning frames 2 are provided for one automatic winder 1. The automatic winder 1 is provided with an empty bobbin discharging portion 3 and a spinning bobbin receiving portion 4, and the spinning frame 2 is provided with a spinning bobbin discharging portion 5 and an empty bobbin receiving portion 6. The empty bobbin discharging portion 3 and empty bobbin receiving portion 6, and the spinning bobbin discharging portion 5 and spinning bobbin receiving portion 4 are connected by carrier route 7, 8, respectively. As is apparent from the figure, eight carrier routes 7, 8 cross each other, and it is extremely difficult to provide the carrier routes 7, 8 without interference when they transport work from a higher position to a lower position.

Figure 2:
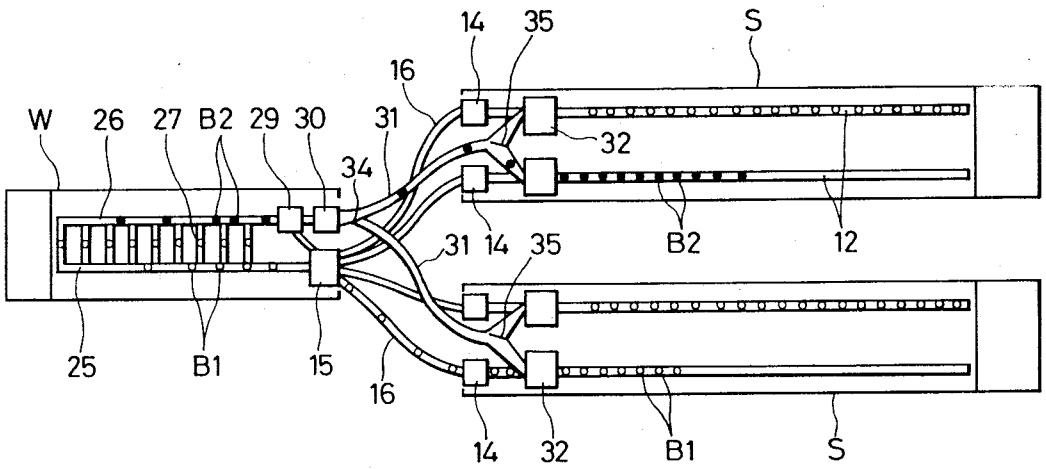
FIG. 2 and 3 are respectively a plan view and a side view of a spinning winder in accordance with the present invention.
Figure 3:
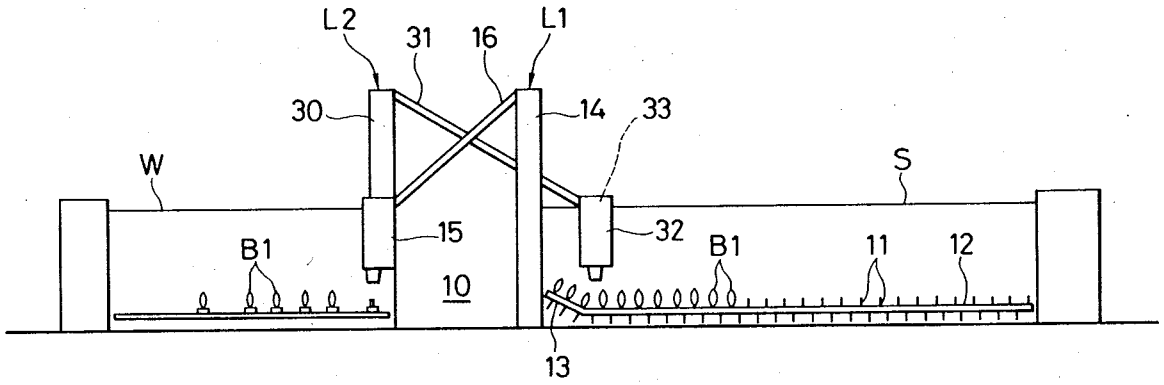

FIGS. 2 and 3 are a plan view and a side view, respectively, showing an embodiment of a spinning winder in accordance with the present invention. Two spinning frames S are provided for one automatic winder W. A work passage 10 of a given width is provided between the spinning frame S and the automatic winder W, and carrier routes L1, L2, later described, are provided above the work passage 10.

Figure 4:
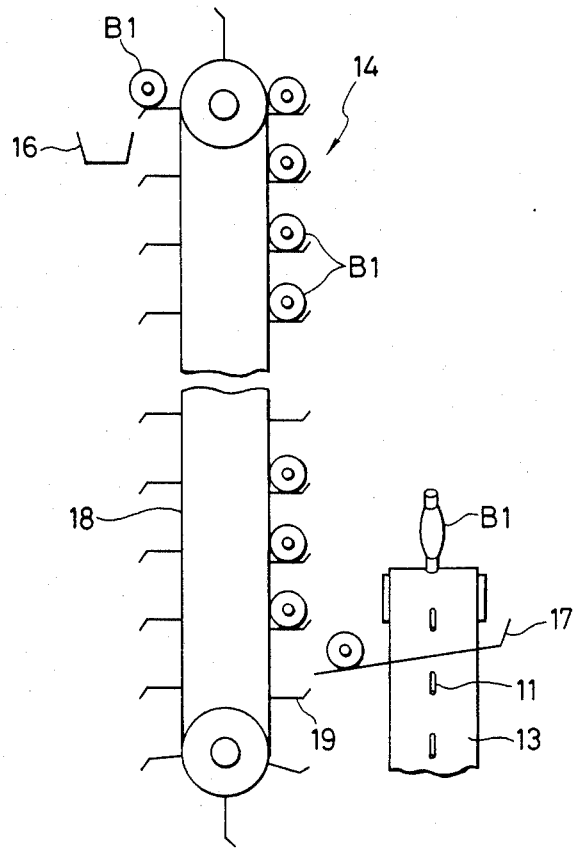
FIG. 4 is a side view showing a part of the carrier route of the spinning bobbin.

On both sides of the spinning frame S, transport bands 12 having a number of pegs 11 planted on the upper surface of the belt are provided along the machine bed, the transport bands 12 being intermittently rotated alternately forward and rearward by a driving source, not shown, to transport spinning bobbins B1 doffed from a spindle portion of the spinning frame S towards the automatic winder W and to supply empty bobbins B2 transported from the winder W to the spindle portion. A side portion of the transport band 12 is somewhat upwardly bended. The spinning bobbin conveyor 14 is vertially stood upright in proximity of the end of a bended portion 13, and a spinning bobbin chute 16 is mounted at an inclined altitude from the upper end of the conveyor 14 towards a spinning bobbin receiving portion 15 of the automatic winder W. FIG. 4 shows the state in which the spinning bobbins B1 are transported from the transport band 12 to the spinning bobbin chute 16 via the spinning bobbin conveyor 14. The spinning bobbins B1 slip off of the pegs 11 by the force of gravity at the end of the transport band 12. The spinning bobbins are guided by a guide 17 and are successively placed on supports 19 secured to a belt 18 of the spinning bobbin conveyor 14. The spinning bobbins then fall into the chute 16 from said supports 19 at the upper end of the conveyor, and slide within the chute 16.

The inclination angles of the spinning bobbin chute 16 and the empty bobbin chute 31 may differ from each other to account for the differences in weight of the spinning bobbin and empty bobbin. The length of the spinning chute 16 and the empty bobbin chute 31 can be made to differ from the other such as to avoid interference of paths.

Figure 5:
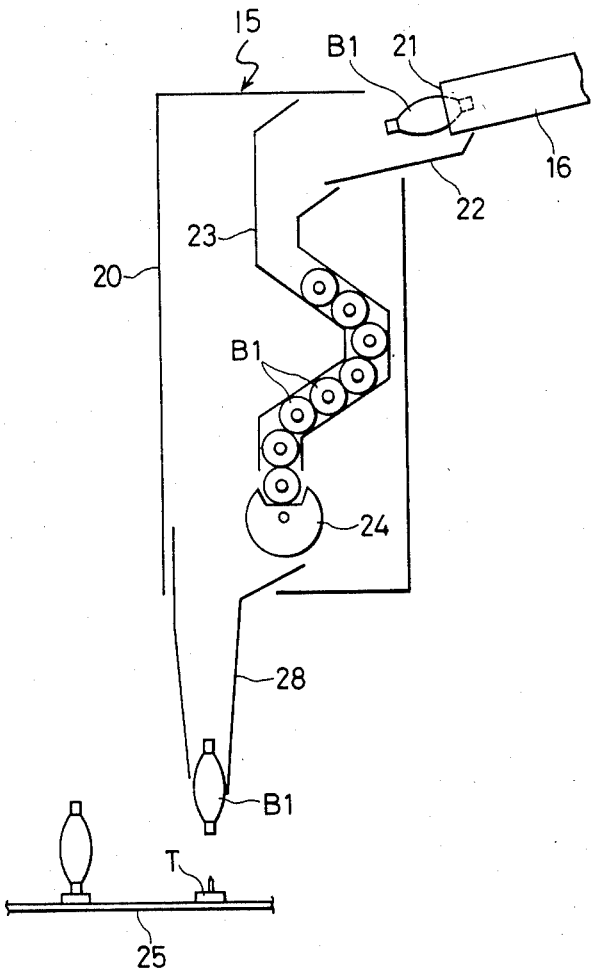
FIG. 5 is a view showing a real bobbin reserve device.

The spinning bobbin receiving portion 15 in the automatic winder W is positioned on the side of the work passage. The spinning bobbins B1 transported from the spinning bobbin chute 16 are received and stored in the receiving portion 15, and a discharging spinning bobbin reserve device 20 is provided. The reserve device 20 is as shown in FIG. 5. Four spinning bobbin chutes 16 mounted on two spinning frames S have lower outlets 21, each of which gathers at a guide 22, and the spinning bobbins B1 discharged from the outlets 21 are temporarily stored in a bended storage pipe 23, after which the bobbins B1 are delivered one by one by a spinning bobbin delivery plate 24 rotated by command requesting the spinning bobbins of the automatic winder W. When the number of the spinning bobbins in the storage pipe 23 becomes to be decreased from the predetermined number, a feeler (not shown) operates and a control device which is actuated by a signal from the feeler outputs a signal for demanding more spinning bobbins to the spinning section. In the spinning section, the transport band 12 arranged on one side of the spinning frame is driven according to the signal for demanding the spinning bobbins to supply the spinning bobbins into the storage pipe 23 in succession of the doffing. After all of the spinning bobbins supported on one transport band are discharged therefrom, the other transport band is driven to supply the spinning bobbins supported thereon. A spinning bobbin supplying belt conveyor 25 and an empty bobbin discharging belt conveyor 26 are disposed along the machine bed forwardly and rearwardly, respectively, of the automatic winder W. Both conveyors 25, 26 are connected to a connection path 27 which passes through a winding unit. Spinning bobbins B1 fall through a chute 28 by operation of the delivery plate 24 and are transported to each of the winding units while being supported on a carrier T placed on the supplying belt conveyor 25. The spinning bobbins are wound by said units into empty bobbins B2, which are discharged onto the discharging belt conveyor 26 as they ride on the carrier T.

At the distal end of the empty bobbin discharging belt conveyor 26 in the automatic winder W, that is, at the end on the side of the work passage, an empty bobbin removing device 29 for removing the empty bobbin B2 from the carrier T is provided. An empty bobbin conveyor 30 similar to the spinning bobbin conveyor 14 in FIG. 4 is provided upright. At the upper end of the conveyor 30, an empty bobbin chute 31 similar to the spinning bobbin chute 16 is provided. The empty bobbin chute 31 is branched into two parts, which are mounted at an inclined altitude towards an empty bobbin reserve device 33 within an empty bobbin receiving portion 32, which has a similar structure to that of the spinning bobbin reserve device 20 mentioned above. At said branched portion, there is provided a movable partitioning plate 34 which whirls to suitable switch an empty bobbin supply path so that the same number of empty bobbins B2 are supplied by command requesting empty bobbin from each spinning frame S thereto. Two empty bobbin reserve devices 33 are provided for one spinning frame S by each transport band 12. Thus, at an outlet at the lower end of the empty bobbin chute 31, there is provided a movable partitioning plate 35 similar to that as described above to distribute the empty bobbins B2 by each of the reserve devices 33.

Accordingly, the switch-over to the spinning frame S in which the signal for requesting the empty bobbins is output is performed by the movable partitioning plate 34 and the switch-over to the empty bobbin receiving portion 32 on the side of the transport band 12 wherein the supply of the empty bobbin is requested is accomplished by the movable partition plate 35. Since the structure of the empty bobbin reserve device 33 is similar to the spinning bobbin reserve device 20 in FIG. 5, it will not be shown and is omitted in detailed description. Doffing is done in the spinning frame S, and the transport band 12 is moved forwardly, that is, towards the automatic winder W to transfer the spinning bobbins B1 onto the spinning bobbin conveyor 14. Thereafter, the transport band 12 begins its backward movement and at the same time the empty bobbins B2 are delivered one by one from the empty bobbin reserve device 33 and placed on the empty pegs 11. While the empty bobbin reserve device 33 is provided at the position on the side of the work passage of the spinning frame S, it will be noted that the device can be provided at the reverse side of the spinning frame S (that is, at the rear position) and when the transport band 12 is moved forward, the empty bobbins are supplied to the pegs 11.

The supply of the empty bobbins mentioned above can be accomplished simultaneously if the both sides of the transport bands 12, 12 discharge empty bobbins at the same time. In this case, the movable partitioning plate 35 is switched-over every time when one empty bobbin passes over it, and thus makes it possible to supply empty bobbins to each transport bands 12, 12, simultaneously.

In the above-described spinning winder, the spinning bobbin chute 16 and empty bobbin chute 31 linearly cross each other as shown in FIG. 3 in the side view but cross each other while depicting a gentle curve in the plan view. Curves of the chutes 16, 31 are formed so that the spinning bobbins B1 or empty bobbins B2 may smoothly travel by means of gravity within the chutes and the chutes 16, 31 do not interfere with each other. Where the carrier route L1 comprising the spinning bobbin conveyor 14 and spinning bobbin chute 16, or the carrier route L2 comprising the empty bobbin conveyor 30 and empty bobbin chute 31 comprises a mere single conveyor, it is not possible to bend the chute in a three-dimensional manner. However, the spinning bobbin chute 16 and empty bobbin chute 31 in the present spinning winder can be obtained merely by bending or joining a metal plate into a channel-like section, said curves being freely formed. The spinning bobbin and empty bobbin conveyors 14, 30 are stood upright at the end on the side of the work passage of the spinning frame S and automatic winder W, and the chutes 16, 31 are mounted from the upper ends of the conveyors 14, 30. Therefore, the chutes 16, 31 cover the whole width of the work passage 10. Bending of the chutes 16, 31 can be reduced through that amount and the sliding of the spinning bobbins B1 or empty bobbins B2 within the chutes can be made smooth. Moreover, comparing with the structure in which the bended portion 13 of the transport band 12 is extended in place of the conveyors 14, 30, there provides an advantage that a floor area can be saved through a portion of a horizontal length of the bended portion 13 to provide a wide work passage.

In the present spinning winder, the automatic winder and spinning frame may be provided in the ratio of 1:1. However, more remarkable effects may be attained by the arrangement wherein a plurality of spinning frames are provided for one automatic winder.

What is claimed is:

1. A spinning winder comprising:

a spinning frame, said spinning frame having an end and an empty bobbin receiving portion;

an automatic winder integrally associated with said spinning frame, said winder having an end and a spinning bobbin receiving portion;

a work passage located between said end of said spinning frame and said end of said automatic winder;

a transporting device connecting said end of said automatic winder with said end of said spinning frame for transporting empty and spinning bobbins therebetween, said transporting device comprising:

a spinning bobbin conveyor located at said end of said spinning frame for upwardly transporting spinning bobbins doffed by said spinning frame, said spinning bobbin conveyor having an upper end located at a height above that of the spinning bobbin receiving portion;

a spinning bobbin chute mounted above said work passage and being downwardly inclined from the upper end of said spinning bobbin conveyor to said spinning bobbin receiving portion of said winder;

an empty bobbin conveyor provided at said end of said winder for upwardly transporting empty bobbins discharged by said automatic winder to an upper end which is located at a height above that of the empty bobbin receiving portion;

an empty bobbin chute mounted above said work passage and being downwardly inclined from the upper end of said empty bobbin conveyor to the empty bobbin receiving portion of the spinning frame; and a transport band for transporting spinning bobbins from said spinning frame to said spinning bobbin conveyor, said transport band having an end portion and said spinning bobbin conveyor comprising an endless belt with supports secured on said belt, said spinning bobbin conveyor being stationed in an upright manner in proximity of said end portion of said transport band for conveying spinning bobbins doffed from said transport band to said spinning bobbin chute.

2. A spinning winder as claimed in claim 1, further comprising:

a spinning bobbin supplying belt conveyer disposed along said winder for supplying spinning bobbins to said winder;

a spinning bobbin reserve device located at the spinning bobbin receiving portion of the automatic winder for storing said spinning bobbins discharged from said spinning bobbin chute and supplying spinning bobbins one at a time to said spinning bobbin supplying belt conveyor.

3. A spinning winder as claimed in claim 2, further comprising:

a conveyor belt provided adjacent to the winder;

carriers located on said conveyor belt, wherein said spinning bobbin chute has a lower end, and said spinning bobbin reserve device comprises:

a guide disposed in proximity to said lower end of said spinning bobbin chute;

a bent storage pipe arranged below said guide for temporarily storing said spinning bobbins;

a turnable delivery plate located below said storage pipe for discharging said spinning bobbins one at a time when turned; and a chute located between said movable delivery plate and said conveyor belt for supplying spinning bobbins to said carriers.

4. A spinning winder as claimed in claim 1, further comprising:

an empty bobbin discharging belt conveyor located adjacent said winder for transporting empty bobbins from said winder, said empty bobbin discharging belt conveyor having an end;

carriers disposed on said empty bobbin discharging belt conveyor for conveying empty bobbins; and an empty bobbin removing device for removing empty bobbins from said carriers, wherein said empty bobbin discharging belt conveyor is provided in proximity to said empty bobbin conveyor and wherein the empty bobbin conveyor is vertically stood upright.

5. A spinning winder as claimed in claim 1, wherein said empty bobbin chute comprises:

a plurality of branched parts;

a branched portion at which each branched part branches; and a whirling movable partitioning plate located at said branched portion which whirls to direct empty bobbins into one of said plurality of branched parts.

6. A spinning winder as claimed in either claim 1 or 5, further comprising:

a plurality of transport bands located adjacent to said spinning frame; and a plurality of empty bobbin reserve devices located at said empty bobbin receiving portion of said spinning frame, the number of empty bobbin reserve devices corresponding to the number of transport bands located adjacent to said spinning frame.

7. A spinning winder, comprising:

a first spinning frame;

a second spinning frame;

a winder;

a passage located between both said first and second spinning frames and said winder;

an empty bobbin conveyor for transporting empty bobbins in a substantially vertical direction from said winder;

a first empty bobbin chute for transporting empty bobbins from said empty bobbin conveyor to said first spinning frame over substantially the entirety of said passage;

a second empty bobbin chute for transporting empty bobbins from said empty bobbin conveyor to said second spinning frame;

a first spinning bobbin conveyor for transporting spinning bobbins in a substantially vertical direction from said first spinning frame;

a second spinning bobbin conveyor for transporting spinning bobbins in a substantially vertical direction from said second spinning frame;

a first spinning bobbin chute for transporting spinning bobbins from said first spinning bobbin conveyor to said winder over substantially the entirety of said passage;

a second spinning bobbin chute for transporting spinning bobbins from said second spinning bobbin conveyor to said winder over substantially the entirety of said passage; and said first empty bobbin chute, said second emtpy bobbin chute, said first spinning bobbin chute and said second spinning bobbin chute crossing over one another in space above said passage.

8. A spinning winder according to claim 7, wherein said first and second spinning bobbin chutes decline in altitude in the direction of said winder, and said first and second empty bobbin chutes decline in altitude in the direction of said first and second spinning frames, respectively.

9. A spinning winder according to claim 8, further comprising:

a first spinning bobbin discharging means adjacent said first spinning bobbin chute for discharging spinning bobbins onto said winder; and a second spinning bobbin discharging means adjacent said second spinning bobbin chute for discharging spinning bobbins onto said winder.

10. A spinning winder according to claim 8, further comprising:

a first empty bobbin discharging means adjacent said first empty bobbin chute for discharging empty bobbins onto said first spinning frame; and a second empty bobbin discharging means adjacent said second empty bobbin chute for discharging empty bobbins onto said second spinning frame.

* * * * *